United States Patent [19]

McGuire

[11] 4,108,439

[45] Aug. 22, 1978

[54] SPRINKLER HEAD LOCATER AND MARKER AND METHOD

[76] Inventor: Murvail C. McGuire, 7820 Mackinaw Trail, Cadillac, Mich. 49601

[21] Appl. No.: 676,726

[22] Filed: Apr. 14, 1976

[51] Int. Cl.[2] ..... B05B 15/06; A63B 69/36

[52] U.S. Cl. ..... 273/176 R; 273/178 R; 273/32 R; 47/41.1; 239/201; 172/19; 273/DIG. 24

[58] Field of Search ..... 47/32, 33, 25, 41.1; 273/DIG. 24, 32 R; 172/19; 239/201, 288.5; 276/176 R, 176 A, 176 AA, 176 AB, 35 B

[56] References Cited

U.S. PATENT DOCUMENTS

| | | | |
|---|---|---|---|
| 1,139,515 | 5/1915 | Haas | 47/33 UX |
| 2,080,341 | 5/1937 | Schumacher | 239/201 |
| 3,015,448 | 1/1962 | Hurless | 47/25 X |
| 3,265,310 | 8/1966 | Cohen | 239/201 |
| 3,520,082 | 7/1970 | Smith | 47/33 |
| 3,918,719 | 11/1975 | Welch | 273/DIG. 24 |

FOREIGN PATENT DOCUMENTS

| | | | |
|---|---|---|---|
| 3,615 of | 1902 | United Kingdom | 47/32 |

*Primary Examiner*—George J. Marlo

*Attorney, Agent, or Firm*—Price, Heneveld, Huizenga & Cooper

[57] ABSTRACT

The specification discloses a device and method for marking the position of and for protecting an inground object such as a sprinkler head including a hollow, open-ended tubular member which is adapted to be placed around the object and inserted into the ground. An outwardly directed ring which includes a depending lip is formed integral with and adjacent the upper end of the member. The ring stabilizes the device and limits the depth of insertion of the tubular member. The method also comprises including indicia on a portion of said member when it is used on a golf course for indicating the distance to the flag stick and hole on a green from the location of the member.

12 Claims, 5 Drawing Figures

SPRINKLER HEAD LOCATER AND MARKER AND METHOD

BACKGROUND OF THE INVENTION

This invention relates to a device for locating and marking the position of an object embedded in the ground and more particularly, to a unique locator and marker for underground sprinkler heads and the like.

In the maintenance and grooming of large lawns, golf courses, parks, and other such grassy areas, underground sprinkler systems are generally employed. These systems typically include a series of interconnected pipes or a single length of pipe which is embedded below the surface of the ground. A plurality of sprinkler heads, or nozzle structures are connected to the buried pipeline at spaced intervals. Generally, a standpipe arrangement is positioned around the nozzle structure and a cover is hingedly connected to the standpipe or fixedly positioned on top of the nozzle structure. When the main water supply is turned on, the nozzle will rise above the ground surface for sprinkling purposes. Alternately, a portable nozzle can be manually inserted in the inground standpipe connected to the supply pipe.

In any of the above-mentioned areas of use for underground sprinkling systems, and especially in the use of such systems for golf courses, problems are encountered in locating the sprinkler heads. In a typical golf course watering system, the sprinkler heads will be spaced at intervals of 80 feet. These water systems are generally activated only in the late evening or at night since the courses are used during the daylight hours. Further, it is general practice to activate only alternate sprinkler heads on alternate days of the week. This practice ensures sufficient watering to maintain the fairway area of a golf course in good condition. Since the sprinkler heads are so widely spaced, problems are encountered in locating the specific sprinkler head to be activated on the specific day.

During maintenance operations, if the sprinkler head hangs up and/or the cover fails to fully close on the standpipe structure, the sprinkler heads become a source of damage to grounds maintenance equipment such as lawn mowers. If the cover or head extends above the grass surface and is not noticed by the mower operator, lawn mower blades may be nicked and/or severely damaged.

Moreover, since the sprinkler heads are usually manually activated for proper sequencing, it is very difficult for the operator to locate the particular sprinkler heads in dim light or at night.

The problems heretofore experienced are further aggravated by the collection of dirt and/or debris in the area of the sprinkler head which may result in malfunctioning of the system. Generally, each sprinkler head must be dug out on a regular basis, generally at two to three-month intervals.

A need, therefore, exists for a simple, easily manufactured device which may be employed to mark the location of each sprinkler head and thereby increase the ease with which it may be located. Further, such a device should serve to protect the sprinkler head mechanism from dirt and debris, prevent contact of the mechanism with lawn maintenance equipment, such as lawn mowers, and further serve to properly instruct grounds maintenance personnel on the proper activation of alternate sprinkler heads at alternate times.

SUMMARY OF THE INVENTION

In accordance with the present invention, a unique device and method for marking and locating the position of an inground object is provided whereby the problems heretofore experienced are substantially alleviated. Essentially, the device includes a hollow member which is adapted to surround the object and be inserted into the ground. Provision is made for limiting the depth of insertion of the member and for stabilizing the orientation of the member once placed around the object. The limiting and stabilizing arrangement also marks the location of the embedded object and prevents contact between the object and various lawn maintenance equipment.

The method includes inserting a member about an inground object for protection of same while limiting the depth to which the member is inserted. In another aspect, the method includes inserting alternately colored members about alternate sprinkler heads for identifying heads to be used at alternate times. In yet another aspect, the method includes the provision of indicia on the sprinkler locating member to gauge the distance to the green to aid golfers in playing to the green.

DETAILED DESCRIPTION OF THE PREFERRED EMBODIMENT

Figure 1:
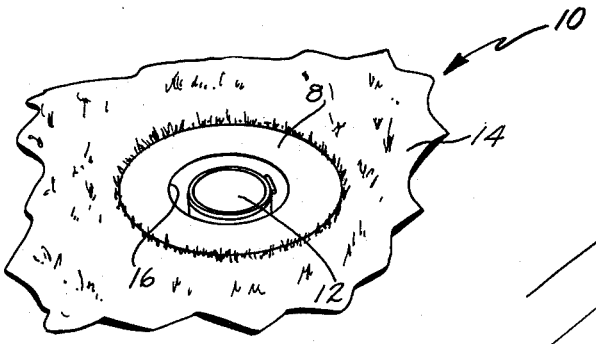
FIG. 1 is a perspective view of the device in accordance with the present invention positioned around a sprinkler head.
Figure 3:
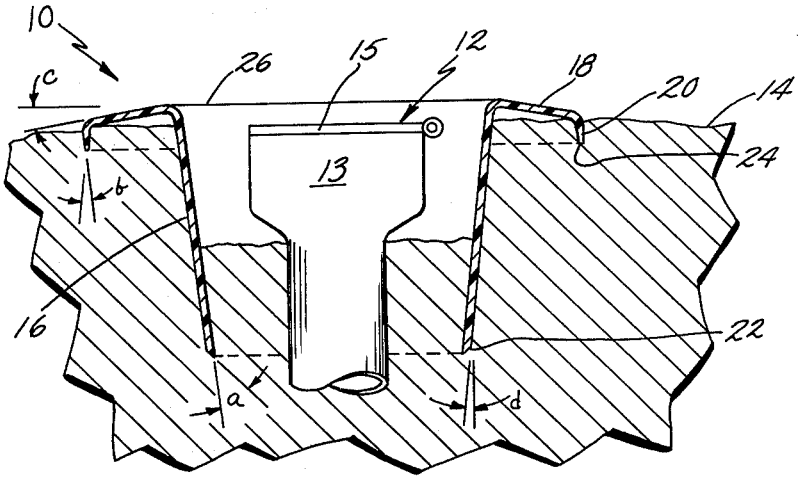
FIG. 3 is a side, elevational view of an installed device in accordance with the present invention.

The preferred embodiment of a device in accordance with the present invention is illustrated in the drawings and generally designated 10. As best seen in FIGS. 1 and 3, the device 10 is preferably employed to mark the location of and to protect a sprinkler head structure 12 embedded within the ground 14. The typical sprinkler head structure 12 is shown for illustrative purposes only as including a standpipe structure 13 and a hinged cover 15.

The marking and protective device in accordance with the present invention includes a generally tubular member 16 which is adapted for insertion into the ground, as shown, the device totally surrounds the sprinkler head 12. The tubular member 16 is a hollow structure, preferably open at both ends. The member 16 is illustrated as being in the shape of a truncated cone having an upper diameter and cross-sectional area which is greater than the lower diameter and cross-sectional area. In other words, the member 16 tapers inwardly and is frusto conical in the preferred embodiment. Formed integrally with and extending outwardly from the upper end of the member 16 is a flange or ring structure 18. The ring 18 is illustrated as a continuous member extending around the entire periphery of the truncated cone member 16. Formed integral therewith at the outer circumference of the ring 18, is a depending skirt or lip 20.

The lower end 22 of the truncated cone member 16 is beveled so as to define a relatively sharp cutting edge (FIG. 3). The taper of the member 16 and a cutting edge substantially increases the ease with which the device may be inserted into the ground around the sprinkler head structure. In a similar manner, the depending skirt 20 is tapered or beveled in cross section so as to define a relatively sharp cutting edge 24. Cutting edge 24 similarly increases the ease with which the device may be embedded in the ground around the sprinkler head.

In the preferred construction, the flange or ring 18 is angled downwardly from the horizontal to define an upraised crown-like portion 26 where the ring 18 joins the tubular member 16. When installed, the marker 10 is pushed into the ground so that the outer area of the ring 18 contacts the upper surface of the ground 14. The crown portion 26 then extends upwardly above the top of the sprinkler head 12. As a result, crown 26 serves to raise a lawn mower or other grounds maintenance equipment as it passes over the sprinkler head. This action prevents or substantially reduces the chance of contact between the lawn mower blades and the top of the sprinkler head thereby preventing damage to both the blades and the sprinkler structure.

Further, when the marker is installed around the sprinkler, dirt may be removed from directly around the sprinkler head. The device prevents collapse of the surrounding dirt around the sprinkler head. By being able to remove the dirt from around the area of the sprinkler head, the mechanism is protected from malfunction. Dirt, stones, and other debris are no longer present around the valve structure and, therefore, will not interfere with proper closing of the cover 15 on the standpipe 13.

Figure 4:
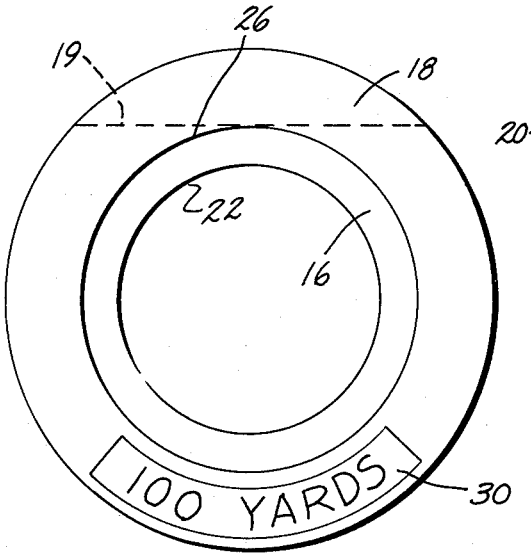
FIG. 4 is a top, plan view of a device in accordance with the present invention.

In order to allow use of the invention around sprinkler or misting heads closely adjacent sidewalks, buildings, or other objects, flange 18 may be cut off on one side such as along rectilinear edge 19 (FIG. 4). The protective member may then be inserted around the sprinkler head immediately adjacent the building or sidewalk.

Cutting edge 24 or flange 20 also enables the invention to be slid up and down in its position around the sprinkler head in order to periodically cut off weeds or grass which may grow over flange 18. The device is merely lifted up sufficiently and pushed downwardly to sever the overgrown weeds or grass to provide a neat edge around the device. This also helps maintain effective visibility for the device and sprinkler.

As best seen in FIGS. 1 and 4, the continuous ring 18 provides a large surface which flags or marks the location of each individual sprinkler head. The device may be formed in a variety of colors to increase the ease by which the sprinkler head may be located. For example, the device may be provided in white and international orange colors. By alternating the color of the device employed with a series of sprinkler heads, as by alternating white and orange devices, the particular sprinkler heads to be activated on a particular day may be readily determined by an operator. For example, sprinkler heads to be activated on Monday, Wednesday and Friday may be marked with a white colored device. Sprinkler heads to be activated on Tuesday, Thursday, and Saturday may be marked with an orange colored device. Therefore, the device in accordance with the present invention readily instructs ground maintenance personnel on the proper operation of the sprinkler system for optimum sprinkling.

The device in accordance with the present invention may be easily molded as a one-piece item from any high impact strength, flexible, weather-resistant, plastic material, the preferred materials being polypropylene or polyethylene. During the manufacturing process, the ring 18 and/or other portions of the device may be formed with a fluorescent material embedded therein. The use of such a fluorescent material embedded in the plastic will increase the ease by which the sprinkler heads may be located at night. The use of fluorescent material, therefore, further complements the visibility provided by the use of bright colors, such as white or international orange.

Figure 5:
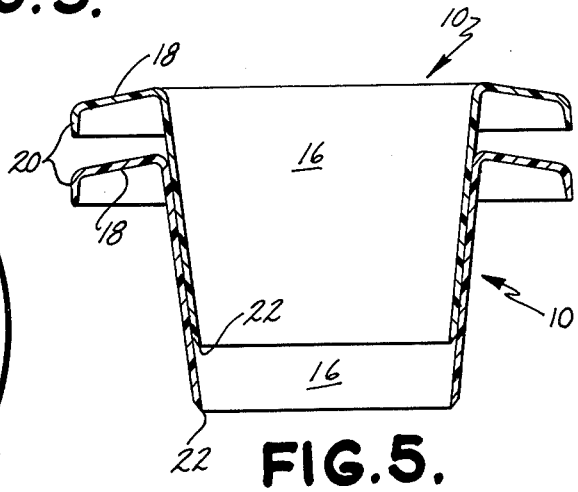
FIG. 5 is a cross-sectional, elevational view showing the manner by which a plurality of the devices may be nested for storage and/or shipping purposes.

Also, forming the tubular member 16 with a taper permits stacking or nesting of a plurality of the markers as shown in FIG. 5. Such stacking decreases the storage requirements and/or increases the ease with which the markers may be transported. As previously stated, the taper also increases the ease of insertion of the device into the ground.

As best seen in FIG. 4, the marker and locater may be employed as a substitute for or an addition to distance markers presently used on golf courses. Generally, yardage or distance markers may be placed at selected locations, typically 80 to 100 yards from the green, so that the golfer may better select a particular club for the distance to the flag stick and hole on the green. As shown in FIG. 4, a decal 30 containing yardage information may be placed on the top surface of the ring 18. As an alternative, the yardage information may be imprinted directly on the marker once it is installed on a golf course. The device, therefore, besides locating, marking, and protecting the sprinkler heads of a system, may also communicate information to the users of the particular area with which the sprinkler system is employed.

In an existing embodiment of the present invention, the vertical height of the device is approximately 4 inches, the minimum diameter of the truncated cone is approximately 3.75 inches, and the maximum diameter of the cone is approximately 5 inches. The ring width is approximately 1 to $1\frac{1}{2}$ inches and the skirt height is approximately $\frac{1}{2}$ inch. The device is formed in a two-piece mold and has a wall thickness of approximately 0.1 inch. The lower edge or end 22 of the cone is beveled at an angle a of approximately 30° from the vertical (FIG. 3). The depending skirt or lip 20 is beveled to a sharp edge at an angle b of approximately 10° and the continuous ring 18 is angled downwardly from the horizontal at an angle *c* of approximately 10°. The cone is tapered at an angle *d* of approximately 7°.

Figure 2:
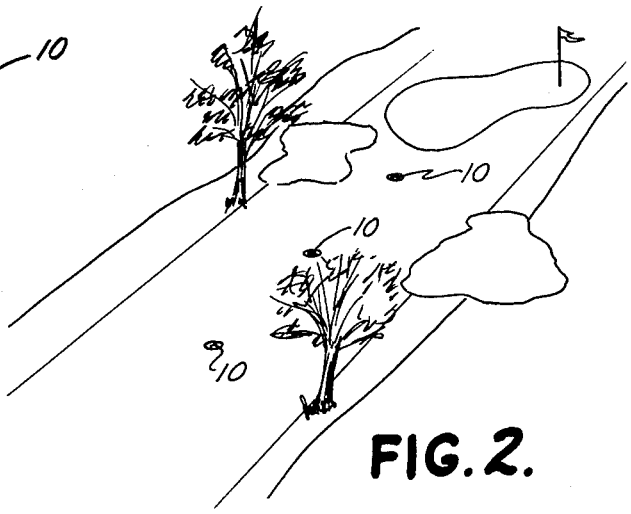
FIG. 2 illustrates the manner in which the device in accordance with the present invention may be employed to mark and locate sprinkler heads employed in a golf course sprinkling system.

In use, the device in accordance with the present invention is readily inserted around a sprinkler head as seen in FIG. 1. The degree of taper of the tubular member 16 may be varied to permit the device to be employed with larger or smaller sprinkler heads. When pressed into the ground, the skirt 20 is embedded in the ground and in conjunction with the ring 18 serves to stabilize or prevent shifting in the orientation of the device. Skirt 20 also cuts off weeds or grass which may have overgrown the sprinkler as described above. As shown in FIG. 2, a plurality of color-coded devices may be employed in a watering system for a golf course as discussed above.

As should be readily apparent to one of ordinary skill in the art, the configuration of the device may be varied from that illustrated in the drawings. For example, the open-ended member 16 may be cylindrical, rectangular, square, or in the shape of a truncated cone as in the preferred form. Additional means for selectively covering or closing one or both ends of the member 16 may also be included. Therefore, it is expressly intended that the above description should be considered as that of the preferred embodiment only. The true spirit and scope of the present invention will be determined by reference to the appended claims.

The embodiments of the invention in which an exclusive property or privilege is claimed are defined as follows:

1. In combination, a device for marking the position of and for protecting a sprinkler valve or head and a sprinkler valve or head within the ground; said device comprising:

a single-piece, hollow member positioned around the valve or head and located in the ground, said hollow member having a tapering, inside surface spaced outwardly away from and surrounding the valve or head to provide an internal open space between said inside surface and the valve or head and which opens vertically around the valve or head, said inside surface tapering upwardly and outwardly from a lower end in the ground to an upper end spaced above said valve or head, the opening at said upper end being larger than the opening at said lower end and the valve or head;

flange means adjacent the upper end of said member and extending outwardly from said upper end for contacting the ground to limit the depth of insertion of said member and to stabilize the orientation of said member in the ground and for deflecting equipment and vehicles up and over said valve or head; said flange means extending around said upper end of said member from a position flush with said inside surface of said hollow member at said upper end and downwardly from said position into contact with the ground; said internal open space between said inside surface and valve or head and said opening at said upper end providing sufficient room for operation of the object such as a sprinkler valve or head while preventing contamination of the object by dirt and debris.

2. A device as defined by claim 1 wherein said lower end of said hollow member opposite said flange means is beveled for increasing the ease of insertion of said member into the ground.

3. A device as defined by claim 1 wherein said flange means includes an outwardly directed, continuous ring extending around said upper end of said hollow member.

4. A device as defined by claim 3 wherein said ring is cut off along one portion thereof to allow insertion of the hollow member around the valve or head which is immediately adjacent a building, sidewalk or object.

5. A device as defined by claim 3 wherein said flange means includes a depending skirt integral with and extending downwardly from the outer peripheral edge of said continuous ring.

6. The device of claim 5 wherein said skirt varies in thickness so as to present a sharp edge for increasing the ease of insertion of the device into the ground.

7. A method of marking the position of and for protecting a sprinkler head or valve, comprising the steps of:

providing a one-piece hollow, tubular member having two open ends, a peripheral flange extending outwardly from the upper one of said two open ends, and a cross-sectional area larger than the sprinkler head or valve;

inserting one end of said hollow member into the ground so that the sprinkler head or valve is surrounded and protected by said hollow member but includes an internal open space between the sprinkler head or valve and said hollow member; and limiting the depth to which said member is inserted while stabilizing said hollow member to prevent a shift in orientation after insertion into the ground by engaging said flange with the ground around the sprinkler valve or head.

8. A method as defined by claim 7 and further including the step of:

removing the ground from around the sprinkler head and within said hollow member to provide said internal open space.

9. A method as defined by claim 8 further including the steps of:

providing additional hollow members;

coloring each of said members in one of two highly visible colors to thereby provide a plurality of alternately colored members;

inserting alternately colored hollow members around alternate sprinkler heads of an underground system to thereby identify and mark each of said sprinkler heads for operation at alternate times.

10. A method as defined in claim 7 including raising said hollow member out of the ground and reinserting said member around the sprinkler valve or head in order to cut or sever weeds, grass, or other growth around and under said member with a flange or skirt on said member.

11. The method as defined by claim 7 including inserting said tubular member only far enough to allow the upper end of said member to project above the sprinkler head or valve.

12. The method as defined by claim 7 wherein the sprinkler head or valve is on a golf course and spaced a predetermined distance from the flag stick and hole marked thereby on a green, said method further comprising including indicia on at least a portion of said member which surrounds and protects the sprinkler head or valve, said indicia indicating said predetermined distance to said hole to aid a golfer in playing his golf ball to the green.

* * * * *